US010693223B1

(12) United States Patent
Hawthorne

(10) Patent No.: US 10,693,223 B1
(45) **Date of Patent: *Jun. 23, 2020**

(54) LOW LOSS TRI-BAND PROTECTIVE ARMOR RADOME

(71) Applicant: ATC Materials Inc, Westlake, OH (US)

(72) Inventor: Mark Hawthorne, Flagstaff, AZ (US)

(73) Assignee: ATC Materials Inc., Westlake, OH (US)

( * ) Notice: Subject to any disclaimer, the term of this patent is extended or adjusted under 35 U.S.C. 154(b) by 28 days.

This patent is subject to a terminal disclaimer.

(21) Appl. No.: 16/411,033

(22) Filed: May 13, 2019

Related U.S. Application Data

(63) Continuation-in-part of application No. 15/574,827, filed as application No. PCT/US2017/039347 on Jun. 27, 2017, now Pat. No. 10,290,935.

(60) Provisional application No. 62/355,301, filed on Jun. 27, 2016.

(51) Int. Cl.
*H01Q 1/42* (2006.01)
*H01Q 1/32* (2006.01)

(52) U.S. Cl.
CPC ..... *H01Q 1/42* (2013.01); *H01Q 1/32* (2013.01); *H01Q 1/3233* (2013.01); *H01Q 1/3275* (2013.01); *H01Q 1/422* (2013.01)

(58) Field of Classification Search
CPC ..... H01Q 1/42; H01Q 1/421; H01Q 1/422; H01Q 1/424; H01Q 1/425; H01Q 1/427; H01Q 1/428
See application file for complete search history.

(56) References Cited

U.S. PATENT DOCUMENTS

| | | | | |
|---|---|---|---|---|
| 4,143,357 | A | 3/1979 | Baver et al. | |
| 4,661,821 | A | 4/1987 | Smith | |
| 4,832,870 | A * | 5/1989 | Clough | C04B 38/0022 252/500 |
| 5,182,155 | A | 1/1993 | Roe | |
| 5,886,667 | A | 3/1999 | Bondyopadhayay | |
| 6,107,976 | A | 8/2000 | Purinton | |
| 6,138,275 | A | 10/2000 | Sacks | |
| 7,420,523 | B1 | 9/2008 | Ziolkowski et al. | |
| 7,688,278 | B2 | 3/2010 | Frenkel | |
| 8,054,239 | B2 | 11/2011 | Wu et al. | |

(Continued)

FOREIGN PATENT DOCUMENTS

EP 2081252 B1 12/2012

*Primary Examiner* — Daniel Munoz
(74) *Attorney, Agent, or Firm* — Invention To Patent Services; Alex Hobson

(57) ABSTRACT

A tri-band multiwall radome includes a dense polymeric strike plate that is configured on the outside of the radome, a capture layer and a tuning layer. The polymeric strike plate is a tough polymer, such as a polycarbonate and breaks a bullet into fragments that are more easily captured by the capture layer. The capture layer includes a number of fabric sheets of highly oriented fibers, such as polyethylene fibers, and a binder. The tuning layer may be a low density foam that is configured inside of the capture layer and provided to reduce reflective losses and improve ballistic performance. A tri-band radome cover may have a dB loss over a wavelength of 8 to 40 kHz of no more than 1 dB. A tri-band radome cover may be formed in a dome shape.

20 Claims, 8 Drawing Sheets

(56) References Cited

U.S. PATENT DOCUMENTS

| | | | | |
|---|---|---|---|---|
| 8,368,610 | B2 | 2/2013 | Kviatkofsky et al. | |
| 8,599,095 | B2 | 12/2013 | Wu | |
| 10,290,935 | B2 * | 5/2019 | Hawthorne | H01Q 1/32 |
| 2006/0162537 | A1 | 7/2006 | Anderson, Jr. et al. | |
| 2008/0136731 | A1 | 6/2008 | Wu et al. | |
| 2010/0050310 | A1 | 3/2010 | Van Es et al. | |
| 2010/0098929 | A1 | 4/2010 | Dispenza | |
| 2010/0293691 | A1 | 11/2010 | Chabba et al. | |
| 2012/0092229 | A1 | 4/2012 | Wu | |
| 2012/0176294 | A1 | 6/2012 | Kviatkofsky | |
| 2013/0002514 | A1 | 1/2013 | Ziokowski et al. | |
| 2013/0316105 | A1 | 11/2013 | Geva et al. | |
| 2014/0000796 | A1 | 2/2014 | Marissen et al. | |
| 2014/0078016 | A1 | 3/2014 | Corodova et al. | |
| 2014/0292612 | A1 | 10/2014 | Boutigny et al. | |
| 2015/0033936 | A1 | 2/2015 | Cummins et al. | |

* cited by examiner

LOW LOSS TRI-BAND PROTECTIVE ARMOR RADOME

CROSS REFERENCE TO RELATED APPLICATION

This application is a continuation in part of U.S. application Ser. No. 15/574,827, filed on Nov. 16, 2017 and now issued as U.S. Pat. No. 10,290,935 on May 14, 2019, which is a national stage entry application of international application no. PCT/US2017/039347 which claims the benefit of U.S. provisional patent application No. 62/355,301, filed on Jun. 27, 2016 and entitled Low Loss Tri-Band Armor Protective Radome; the entirety of each application listed above is incorporated by reference herein.

BACKGROUND OF THE INVENTION

Field of the Invention

The present invention is directed to radomes that provide ballistic protection and have low insertion loss in multi-bands.

Background

A radome is a structural protective cover for an antenna, and in this case a multiband microwave antenna system. A radome traditionally provides protection from rain, dust, sand and is constructed of a material or materials whose dielectric properties and architecture, tuned layers of multiple materials, allow a high transmission efficiency of the microwave signals. Radomes are used to protect a wide variety of antennas from Doppler weather radar antennas to the Traffic Collision Avoidance System (TCAS) on commercial aircraft. Radomes are also used for communications and location of vehicles, such as military vehicles including transport vehicles, HMMWV's, artillery vehicles, tanks, and the like. Radomes on military vehicles require additional ballistic protection, as the antenna system therein can be easily damaged from even small caliber fire. As a result, there is a need for a radome that can both provide high transmission of the microwave signals while also protecting the antenna from ballistic threats.

SUMMARY OF THE INVENTION

The invention is directed to a radome that provides ballistic protection and has low insertion loss in three bands. This is known as a tri-band radome. In an exemplary embodiment, a tri-band radome cover comprises an outside strike plate, a capture layer, and an inner tuning layer. The outside strike plate faces the ballistic threat and is configured to fracture, turn, blunt, or otherwise perturb, the projectile so that it can then be more easily captured by the capture layer. The strike plate layer also adds hermeticity to the radome as well as a tough outer surface that creates a barrier to abrasion and non-ballistic impacts. The capture layer is configured to stop the fragments of the bullet. The tuning layer is configured to reduce signal transmission loss by tuning-out reflective losses. The tuning layer also enhances the ballistic performance of the armor by reducing back-face deformation in addition to adding strength to the overall radome. The three layers of the composite may be adhered together with an adhesive and formed into a dome shape. In an exemplary embodiment, the three layers of the radome composite have diminishing dielectric constants from the outside layer to the inside layer, thereby minimizing overall reflective losses. An exemplary radome, as described herein, has an insertion loss within three bands over a frequency range of about 8 GHz to about 32 GHz of no more than 1 dB at a zero degree incident angle.

An exemplary strike plate comprises a thermoplastic sheet of material such as polycarbonate. A high toughness plastic is preferred as it may more effectively perturb the projectile and may have a toughness of at least about 2 J/cm or more, toughness of at least about 4 J/cm or more, and preferably about 6 J/cm or more, and even more preferably about 8 J/cm of more as determined by the IZOD impact test, ASTM D256, and/or the Charpy impact test method. ASTM A370 and/or the Notched Bar Impact Testing of Metallic Materials, ASTM E23. A strike plate may be configured with a thickness that effectively fragments or slows the projectile while at the same time allowing high microwave signal transmission. The thickness of the plastic strike plate may be at least about 0.5 mm, at least about 0.75 mm, at least about 1 mm, at least about 2 mm and any range between and including the thickness values provided. The actual thickness of this layer depends on the transmission bands of interest. Preferably, the thermoplastic strike plate layer is selected from the group consisting of: polycarbonate, polyetherimide, polystyrenes and polysulfones; the toughness values of these materials is known. A strike plate consists essentially of a thermoplastic polymer sheet, when the sheet is a at least 90% thermoplastic polymer and wherein the thermoplastic may comprise a filler to improve toughness such as a particle filler.

The dielectric constant of the strike plate layer may be about 2 to 4 and preferably about 3.0. The inherent loss of the material, also known as the loss tangent needs to be as low as possible. Loss tangents on the order of 0.02 or less are preferred. A plastic sheet type strike plate for portable radome applications provides protection from the elements as the plastic sheet is impermeable to water. Ballistic covers utilizing a capture layer only, such as those currently available, may be susceptible to water permeation through the fibrous layers of material.

An exemplary capture layer has a lower dielectric constant than the strike plate, and comprises a plurality of woven or non-woven fibrous layers, or sheets, preferably comprising highly oriented polyethylene fibers, such as Spectra, available from Honeywell International, or Dyneema, available from DSM Dyneema B.V. An individual capture layer or sheet may have a fiber orientation direction, or a direction that the majority of the fibers extends. The highly oriented polyethylene fibers, or strands, may be adhered together by an adhesive such as polyurethane. The individual capture layer sheets may be configured with the fiber orientation directions at offset angles, such as orthogonal to each other, or offset at 45 degrees to each adjacent sheet. For example, a first capture layer sheet may be configured with a fiber orientation direction in a first direction and a second and adjacent second capture layer may be configured with a fiber orientation direction in a second direction that is substantially orthogonal to the first direction, within about 10 degrees of orthogonal. In another embodiment, capture layer sheets may be configured with about a 45 degree offset to adjacent capture layer sheets, or with an offset of about 35 and 55 degrees from an adjacent layer. The strands and/or the individual capture sheets may be adhered together by the polyurethane adhesive or binder. The binder may be present in the capture layer in a concentration of about 10% or more, about 14% or more or about 17% or more by weight of the capture layer. Any number of layers of the polyethylene fabric may be configured in the composite radome of the present invention. A balance between bullet capture effectiveness and transmission loss has to be considered however. A capture layer may comprise two or more sheets, four or more sheets, six or more sheets, eight or more sheets, ten or more sheets and any number of sheets between and including the numbers provided. The thickness of the capture layer may be at least about 0.5 mm, at least about 1.0 mm, at least about 2 mm, at least about 3 mm, at least about 4 mm, and any range between and including the thickness values provided. The actual thickness depends on the transmission bands of interest. An exemplary capture layer has a dielectric constant of no more than about 3.0, and preferably no more than about 2.5 and even more preferably no more than 2.2.

An exemplary tuning layer comprises, consists essentially of or consists of a low density material or composite, such as a foam or honeycomb material. An exemplary tuning layer comprises a polyurethane foam, and has a lower dielectric constant than either the strike plate or the capture layer and is provided to reduce reflective losses, increase flexure strength of the radome and reduce backside deformation, the deformation of the armor after ballistic impact. The density of a low density tuning layer material may be no more than 0.64 g/cc, (40 pounds/cubic foot), and preferably no more than 0.50 g/cc, or no more than 0.30 g/cc, and may be as low as 0.065 g/cc, and any range between and including the density values provided such as 0.065 g/cc to about 0.64 g/cc. A tuning layer may comprise a foam, such as an open or dosed cell polyurethane foam. The tuning layer may comprise, consist essentially of, or consists of a foam. A tuning layer may be attached to the capture layer by an adhesive. The thickness of the tuning layer may be at least about 0.2 mm, at least about 3.0 mm, at least about 5 mm, at least about 7 mm, or no more than 10 mm, or no more than 8 mm, and any range between and including the thickness values provided. An exemplary capture layer has a dielectric constant of no more than about 2.0, and preferably no more than about 1.5 and even more preferably no more than 1.2. More importantly, since an exemplary tuning layer is a low density material, such as a foam or honeycomb, a composite of air and polymer, the dielectric constant can be tailored by carefully choosing the density of the foam. The dielectric constant of the tuning layer affects the amplitude of the tuning effect along with the tuning itself, whereas the thickness of the tuning layer affects the tuning only.

As described herein, an exemplary tri-band radome may have a progressively decreasing dielectric constant from the outside surface to the inside surface. Whereby reflective losses between layers is minimized. As described herein in an exemplary embodiment, the strike plate dielectric constant is greater than the capture layer dielectric constant and the capture layer dielectric constant is greater than the tuning layer dielectric constant.

The radome of the present invention may provide high transmission of microwave signals, wherein there is less than 1 dB loss over partial widths of the three bands, X, Ku and Ka, from about 8 to 12 GHz, 12 to 18 GHz and 26 to 30 GHz. The bands of maximum transmission efficiency can be shifted easily to suit many tri-band ranges by optimizing the layer thicknesses of the individual components of the radome wall.

There are two components that affect the transmission efficiency of the radome wall. The first is the inherent material loss which is also known as the material's loss tangent (also known as tan δ). This loss is also a function of frequency and results in an insertion loss per thickness through the material. The second is reflective loss due to impedance mismatches at material interfaces in the radome architecture. This also includes reflections at the interface between air-radome and radome-air at the front and back of the radome, respectively. Reflective losses are unavoidable and their magnitude is proportional to the difference between the dielectric constants that make up the interface. One can imagine a multi-layer radome that produces reflections from all interfaces. These reflections have a magnitude and phase associated with them. Since RF energy is made up of electromagnetic waves, the reflected waves will interfere with each other and with incoming waves. This interference can be either constructive or destructive. If the interference is destructive, then reflective loss is essentially eliminated. This would be easy if the transmitted radiation were of a single wavelength—the thickness could be fixed at one-half wavelength where the reflected wave would be out of phase by 180 degrees and the reflections would essentially be zero. If it is desired that a range of frequencies be allowed to pass through the radome wall freely, then a mathematical model or finite element model is required to predict the performance of the radome. In general, when designing a radome, it is key to adjust the radome thickness or thicknesses so that reflections are minimized and utilize materials with low loss tangents.

To predict complex electrical performance, a transmission line model was created in Mathcad (Ref: Kozakoff, Lien). Each layer of the radome is treated as a two port device, that is, one input and one output. Each input and output has a voltage and a current present. The effect of the material on the voltage and current at the output is determined by an A,B,C,D matrix for each material. To determine the overall effect of a multilayered radome on the incident RF energy, the output of the first layer is input into the input of the second layer and the output of the second layer is input into the input of the third layer, and so on. The propagation constant of each material is calculated, as a function of frequency. The impedance of each layer is calculated and from that the reflection coefficient and the transmission coefficient for each interface is calculated. Special considerations are taken for the interfaces with air and the product of the ABCD matrix is calculated and overall transmission coefficient is calculated. From this, the insertion loss as a function of frequency can be accurately predicted.

Traditional composite ballistic systems consist of a hard strike-face and a backing plate of a very strong oriented fiber composite. During a ballistic impact, the strike-plate acts to fracture, deform, blunt or perturb the projectile while the backing plate acts to dissipate the energy of the projectile or projectile fragments while not allowing penetration. This system has been in use for nearly 50 years and was first patented by Cook, et. al., Typically, for ballistic fabrics to dissipate the energy of ballistic impact, the plate needs to be very strong within the plane of the plate, but weakly bonded in the transverse direction. This weak bonding and subsequent delamination upon impact is, in fact, the energy absorbing mechanism. Ballistic backing plates are typically made of very strong, highly oriented polymer fibers bonded together with an elastomeric thermoplastic. Ballistic fabrics without a binding material are also used, however they do not have any structural capability and are not preferred in this application.

For this invention, it is desired that the tri-band radome cover be certified NIJ level II or NIJ level IIIA. NIJ level II armor defeats five evenly spaced higher velocity 9 mm and 0.357 magnum handgun rounds. NIJ level IIIA armor defeats five evenly spaced 9 mm rifle rounds and 0.44 magnum handgun rounds. Defeats, as used herein is defined in the NIJ certifications, incorporated by reference herein. In an exemplary embodiment, none of the projectile passes through the tri-band radome cover in these tests.

The radome of the present invention may also be required to meet certain minimum load requirements, such as snow and wind loads. An exemplary radome may be required to withstand external forces from snow or wind without any detrimental deformation. In addition, the radome may be required to be water proof and be able to prevent moisture from penetrating through the radome.

An exemplary tri-band radome may be made through any suitable means, however it is important to maintain uniformity of thickness and density of the materials and to avoid wrinkles or creases of materials as they may interfere with signal transmission therethrough. A tri-band radome may be formed by first forming the strike-plate into a desirable shape, such as a dome shape, or a concave shape to accommodate the radar antenna system therein. The strike plate may be thermoformed or vacuum thermoformed into a desired shape, whereby the strike plate is heated and forced into a desired shape, such as a concave shape. The capture layer may then be oriented inside of the concaved shaped strike plate. Capture layer sheets in the form of Spectra or Dyneema are typically sold as two layer non-woven linear sheets where one fiber layer is orthogonal to the second layer. The sheets also include the proper amount of thermoplastic binder. Individual sheets of the capture layer may be oriented carefully within the strike plate and may be oriented with the desired fiber direction at offset angles to each other, such as orthogonally to each other. For example, a first capture sheet may be placed within the concave portion of the strike plate and a second capture sheet may be place orthogonally to the first capture sheet. Placement of individual capture sheets may more enable a buildup of capture layer thickness without forming wrinkles or creases. Placement of a thicker capture layer, comprising a plurality of capture sheets, into the concave shaped strike plate, may more likely form wrinkles, folds or creases. An adhesive may be placed between the strike plate and the capture layer. After all of the capture sheets, or the capture layer is placed and oriented within the concave portion of the strike plate, the temperature of the capture layer may be elevated and the capture layer may be pressed against the strike plate causing consolidation of the fibrous layers into a single rigid capture layer. The pressure may be isostatic, wherein the pressure over the capture layer is substantially uniform even though the geometry is complex. A bladder may be placed within the concave portion of the strike plate and pressurized to isostatically press the capture layer to the strike plate. A bladder may be retained by a clamp or fixture that prevents the movement of the formed strike plate and the inflation of the bladder away from the concave portion of the strike plate.

In another embodiment, the formed strike plate and preformed capture layer are oriented therein and placed in an autoclave. A capture layer may be formed separately from the strike plate and inserted into the strike plate before autoclaving. The assembly may be placed within a vacuum bag and vacuum may be drawn from the bag while the assembly within the bag is heated and pressurized within the autoclave. Either of the two methods may effectively remove porosity from the capture layer and consolidate the capture layer. An exemplary tri-band radome may have a consolidated capture layer having a porosity, percent air volume, of no more than 10% and preferably no more than 5%, and even more preferably, no more than 2.5%. A higher density capture layer, or a capture layer having less porosity, may more effectively prevent projectiles or projectile fragments, such as bullet fragments, from penetrating therethrough.

A tuning layer may be adhered within the concave portion of the strike plate and to the capture layer. Placement and attachment of tuning material in sheet form may be difficult to accomplish in a uniform manner without folds or creases or creating density or thickness changes. Again, uniformity is important to ensure proper signal transmission through the tri-band radome. Wrinkles or creases may create high loss areas and impede signal transmission. In an exemplary embodiment, a tuning layer is reaction molded to the capture layer. A mold may be placed within the concave portion of the strike plate at an offset distance from the oriented capture layer therein, to produce a gap. The tuning layer may then be injected into the gap whereby a tuning layer is formed through foaming, or reaction molding in-situ. The mold may be removed after the tuning layer is formed to produce a tri-band radome that has a smooth interior surface.

An exemplary tri-band radome cover is configured to protect against exposure to the elements including rain, sleet, snow and impact with elements including trees branches, rocks, and ballistic material including bullets or bullet fragments. Military vehicles are often exposed to impacts from elements as they travel through vegetation or through areas with debris caused by explosions or gun fire, for example.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
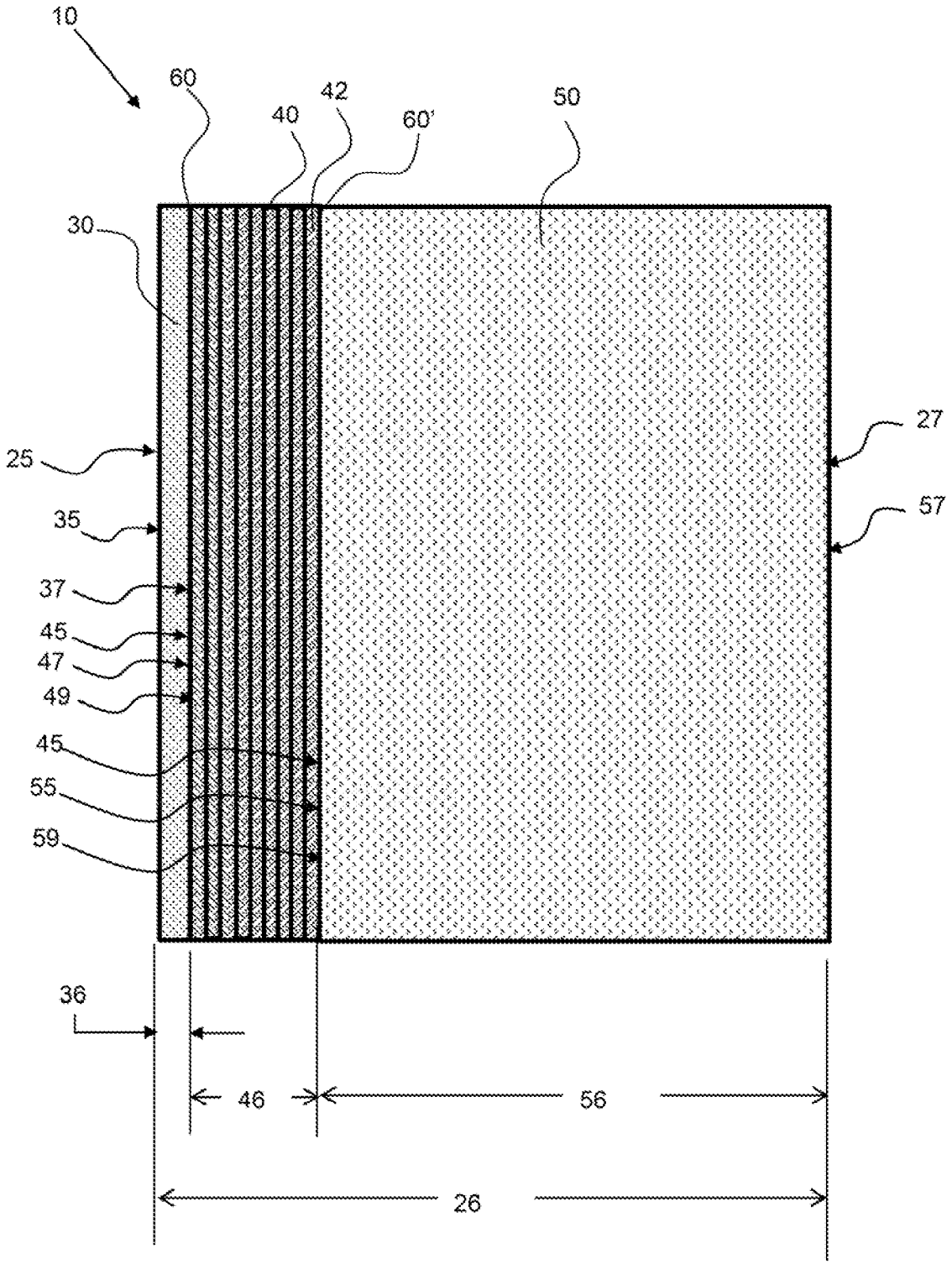
FIG. 1 shows cross section of an exemplary radome.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of Illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

As shown in FIG. 1, an exemplary radome 10 comprises an outside strike plate layer 30, a capture layer 40 comprising a plurality of capture layer sheets 42, and a tuning layer 50. The outside surface of the radome 25, or the outside surface of the strike plate layer 35, faces the elements and is configured protect against exposure to the elements including rain, sleet, snow and impact with trees branches, rocks, and ballistic material including bullets or bullet fragments. The inside surface of the radome 27, or inside surface of the tuning layer 57 faces the antenna. The overall thickness of the radome 26 includes the thickness of the strike plate 36, the thickness of the capture layer 46 and the thickness of the tuning layer 56. There is reflective loss between the inside surface of the strike plate 37 and the outside surface of the capture layer 45, or interface 49 between the strike plate and the capture layer. There is reflective loss between the inside surface of the capture layer 47 and the outside surface of the tuning layer 55, or interface 59 between the capture layer and the tuning layer. A radome configured with layers of diminishing dielectric constants will provide less loss in signal transmission due to tuning losses as described herein. The plurality of capture layer sheets 42 are adhered together to form the capture layer 40. The capture layer may be attached to the strike plate and/or tuning layer by an adhesive 60, 60', respectively, and this adhesive may be the same adhesive that binds and adheres the capture layer sheets together.

Figure 2:
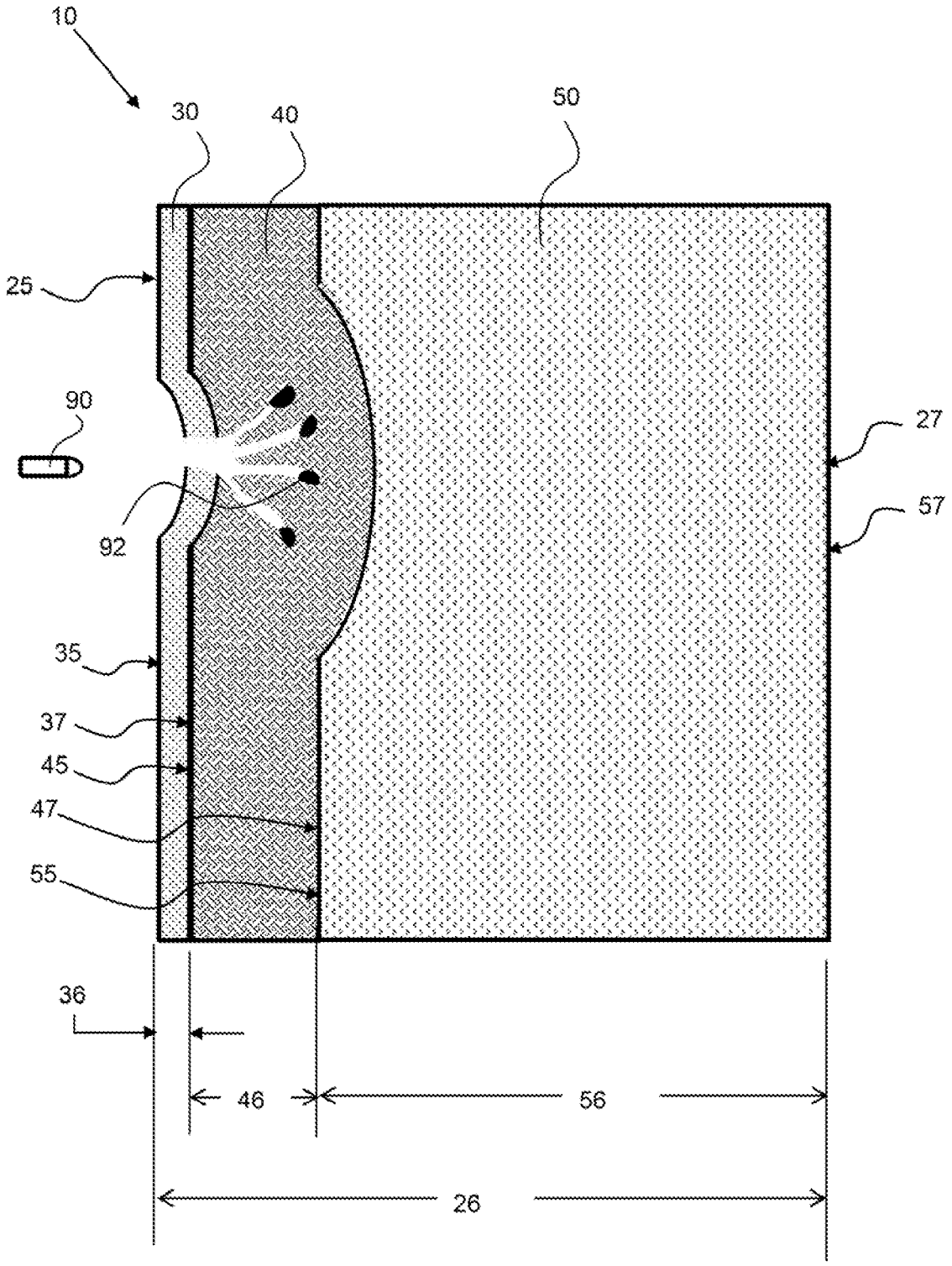
FIG. 2 shows a cross section of an exemplary radome with a bullet captured by the radome.

As shown in FIG. 2, a bullet 90, has been fragmented by the strike plate 30 and is captured in the capture layer 40. The fragments 92 of the bullet are dispersed within the capture layer.

Figure 3:
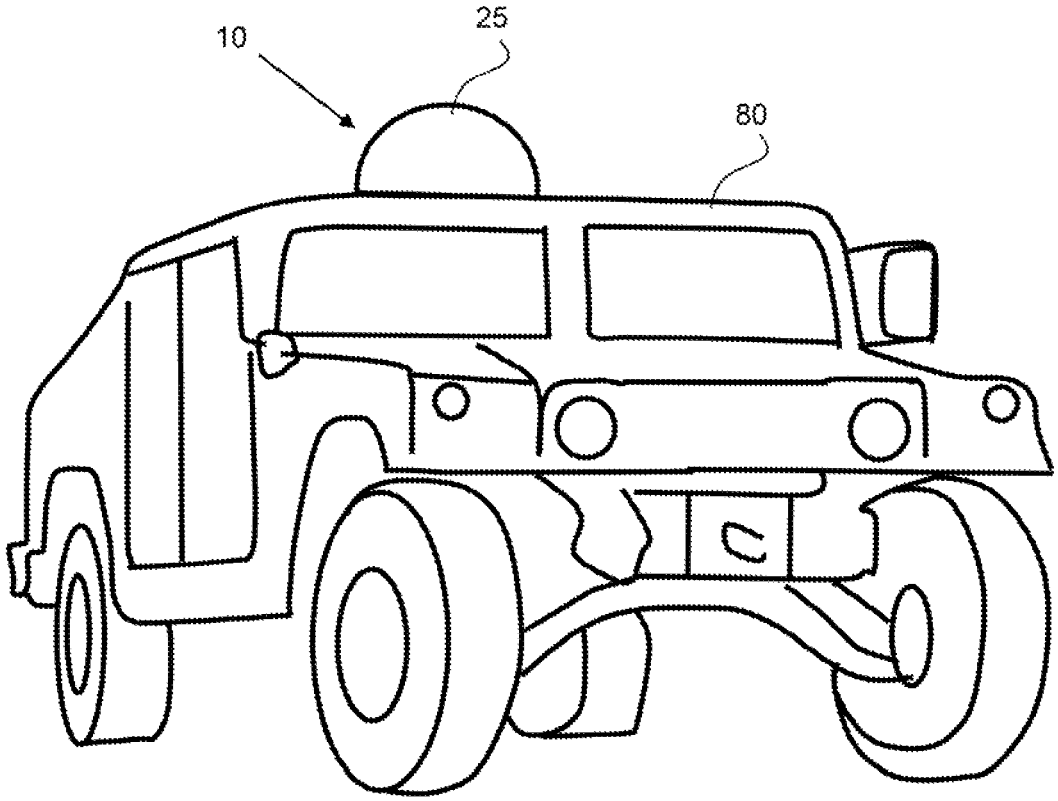
FIG. 3 shows an exemplary radome on a military vehicle.

As shown in FIG. 3, an exemplary radome 10 is configured on a vehicle 80. The outside surface 25 of the radome is exposed to the elements.

Figure 4:
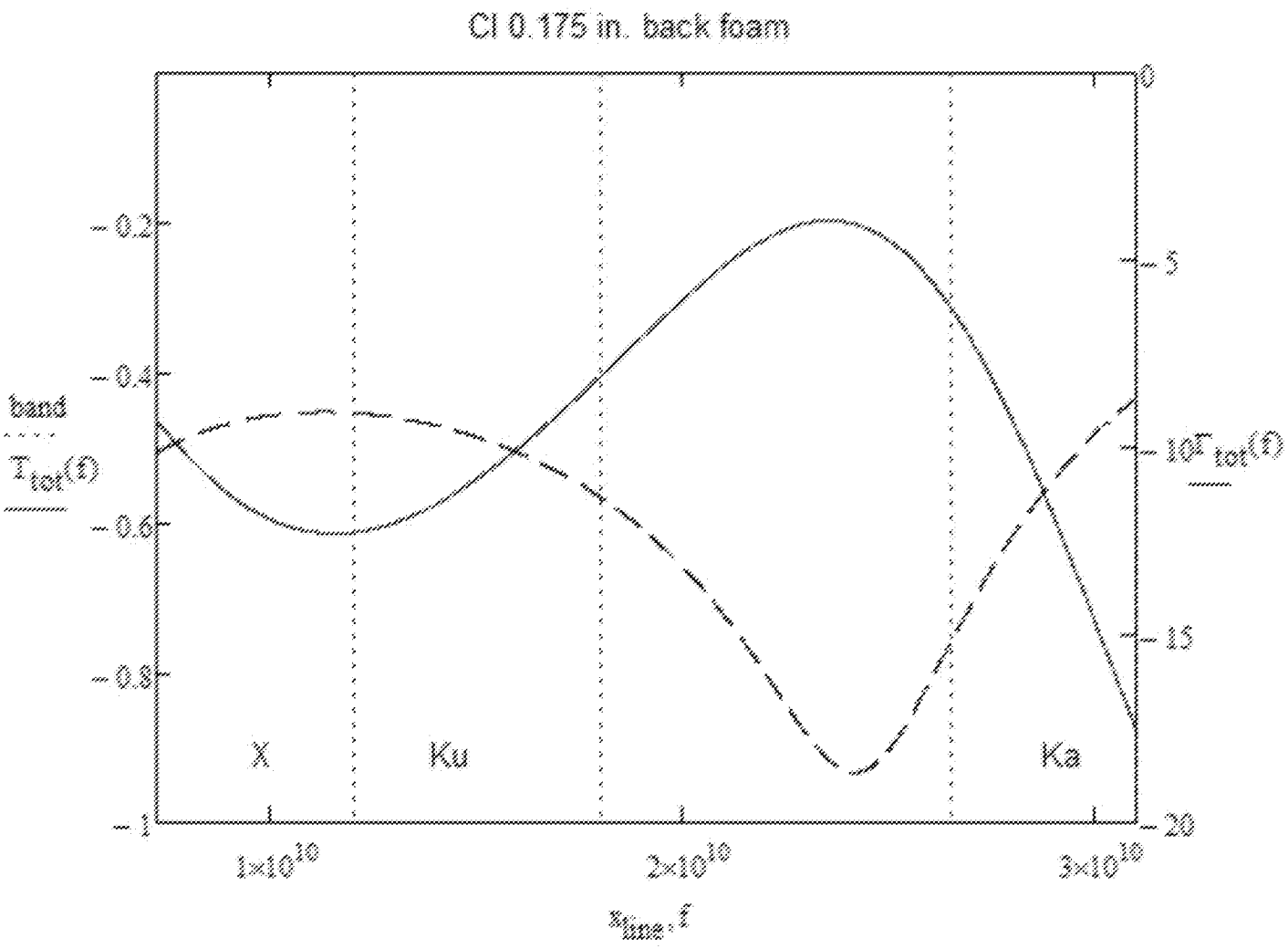
FIG. 4 a graph of microwave transmission loss for a modeled exemplary radome as described herein.

FIG. 4 shows a graph of microwave transmission loss for a modeled exemplary radome as described herein. The model in this embodiment included a 0.175 inch thick tuning layer. Note that the solid line Is the transmission loss which is less than 1 dB over the frequency range from about 8 GHz to 31 GHz. The dashed line is the reflection coefficient.

Figure 5:
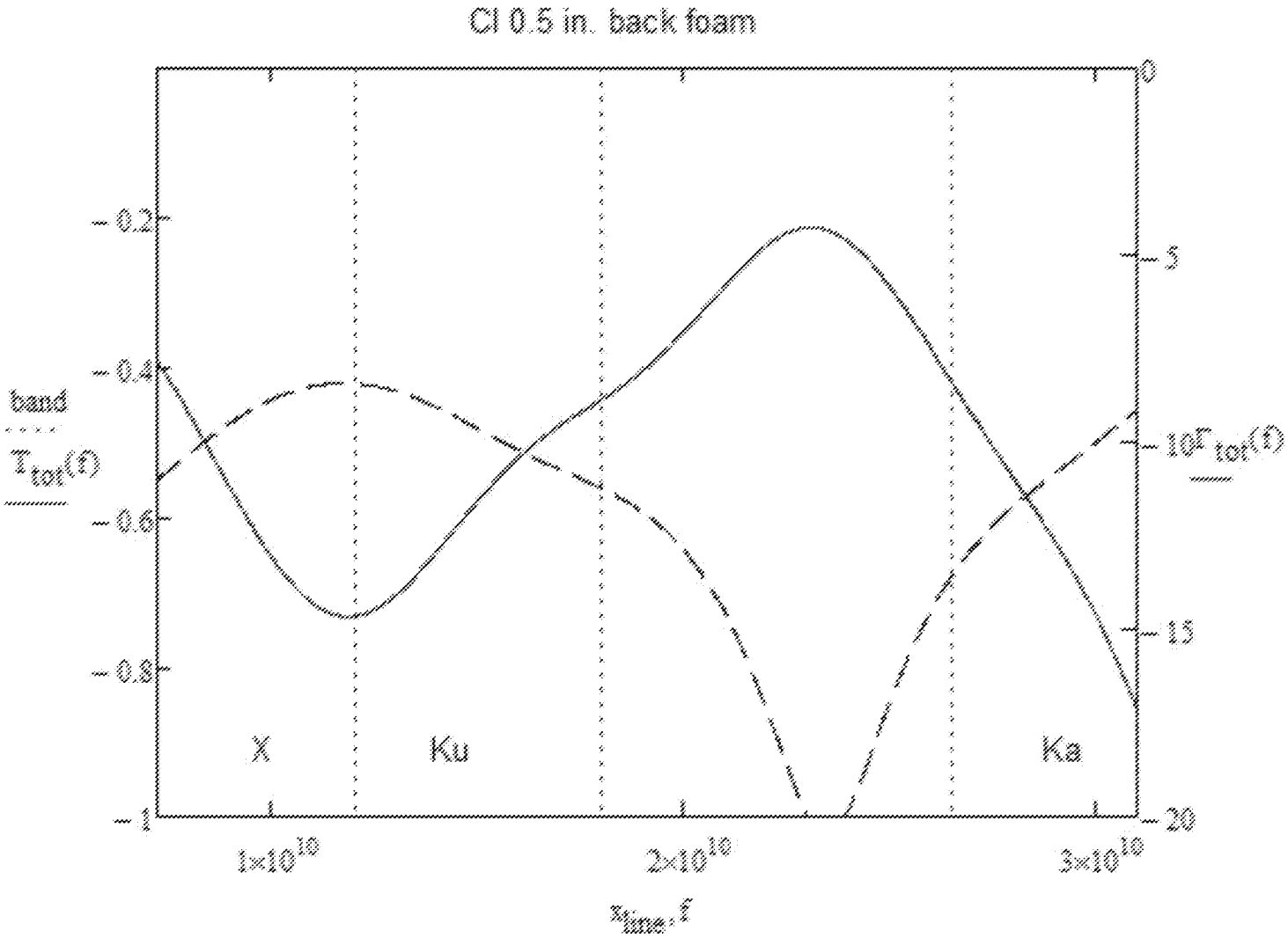
FIG. 5 shows a graph of microwave transmission loss for a modeled exemplary radome as described herein.

FIG. 5 shows a graph of microwave transmission loss for a modeled exemplary radome as described herein. The model in this embodiment included a 0.5 inch thick tuning layer. Again, the transmission loss is than 1 dB over the frequency range.

Figure 6:
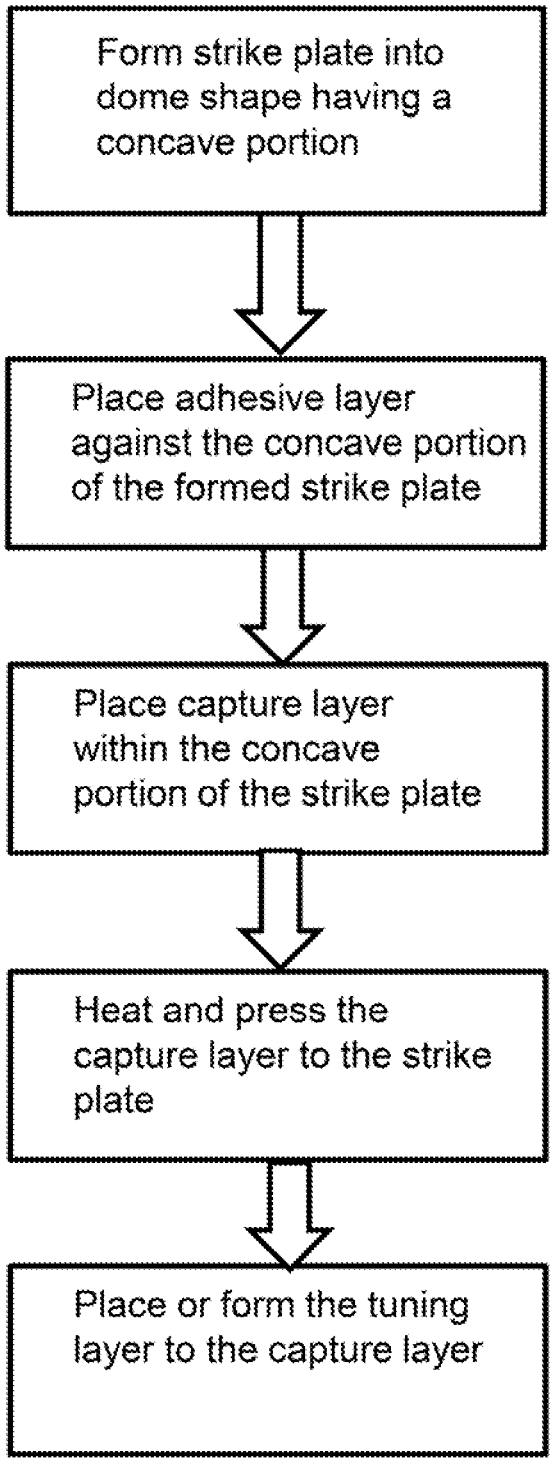
FIG. 6 is a flow diagram for an exemplary method of forming an exemplary tri-band radome.

FIG. 6 is a flow diagram for an exemplary method of forming an exemplary tri-band radome. As described herein, the strike plate may be formed by vacuum thermoforming or by other thermoforming methods or molding methods including injection molding. In vacuum thermoforming the strike plate is heated and pulled into a mold with vacuum. The strike plate may be heated to a temperature below the melting point, whereby the strike plate polymer softens to form the desired shape. As described herein the capture layer may be a composite and may be laid-up over an adhesive and within the formed strike plate. The capture layer may be adhered to the strike plate by the elevation of the temperature and pressing of the capture layer to the strike plate at the same time, the capture layer composite is consolidated. The capture layer may be pressed using an autoclave, wherein the assembly is placed in a bag and is heated and placed in a pressure vessel, an autoclave. In another embodiment, a bladder is used to isostatically press the capture layer to the strike plate and consolidate the capture layer. It may be desirable to reduce any porosity within the capture layer or between the capture layer and the strike plate. Porosity may hinder the capture layer's projectile capture performance and the air may impede proper signal transmission. Finally, the tuning layer may be attached. As described herein, reaction molding may be a preferred way to form a tuning layer to the shaped and formed assembly, as it may reduce the likelihood of wrinkles and/or creases and will ensure uniform density and thickness.

Figure 7:
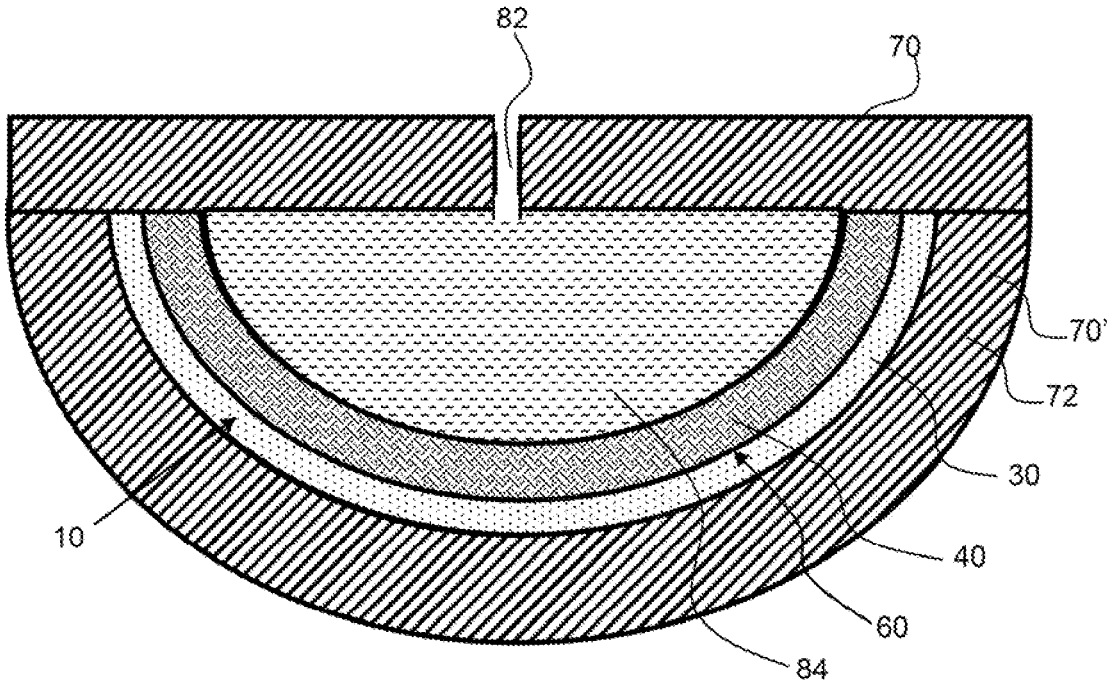
FIG. 7 is a cross sectional diagram of a vacuum form with the vacuum formed strike plate formed therein with the capture layer and adhesive attached to the strike plate and a bladder pressing the capture layer and adhesive to the strike plate.

As shown in FIG. 7, a form 70, such as a vacuum form 72 has a vacuum formed strike plate 30 formed therein with the capture layer 40 and adhesive 60 between the strike plate and the capture layer. A bladder 84 is being inflated to press the capture layer and adhesive to the strike plate through fill port 82. The temperature may be elevated while the bladder is pressing the layers together.

Figure 8:
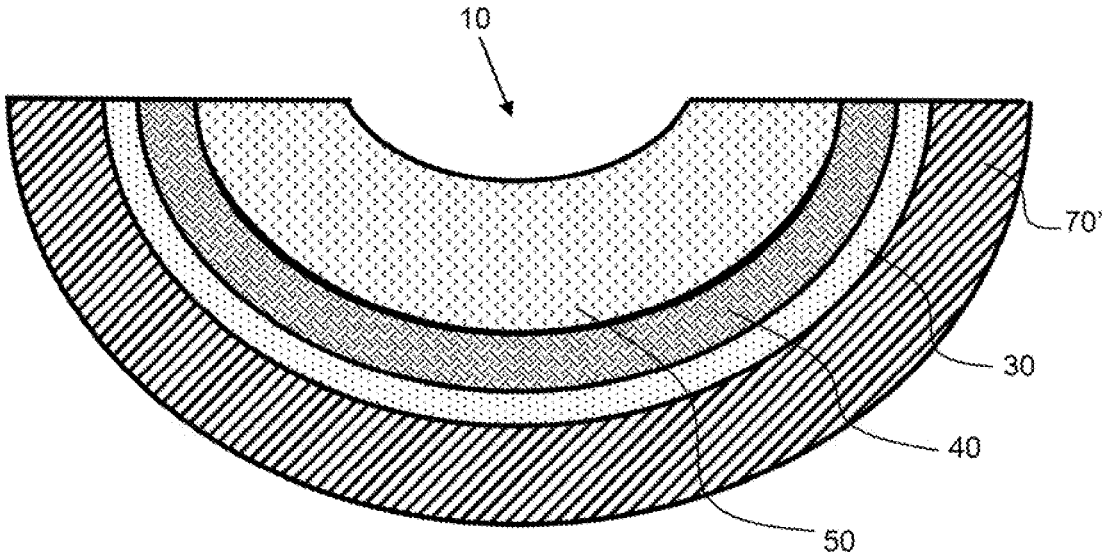
FIG. 8 is a cross sectional diagram of the tri-band radome formed in a vacuum form.

As shown in FIG. 8, the tuning layer 50 is configured within the form 70 and attached to the capture layer to form a tri-band radome cover 10.

Figure 9:
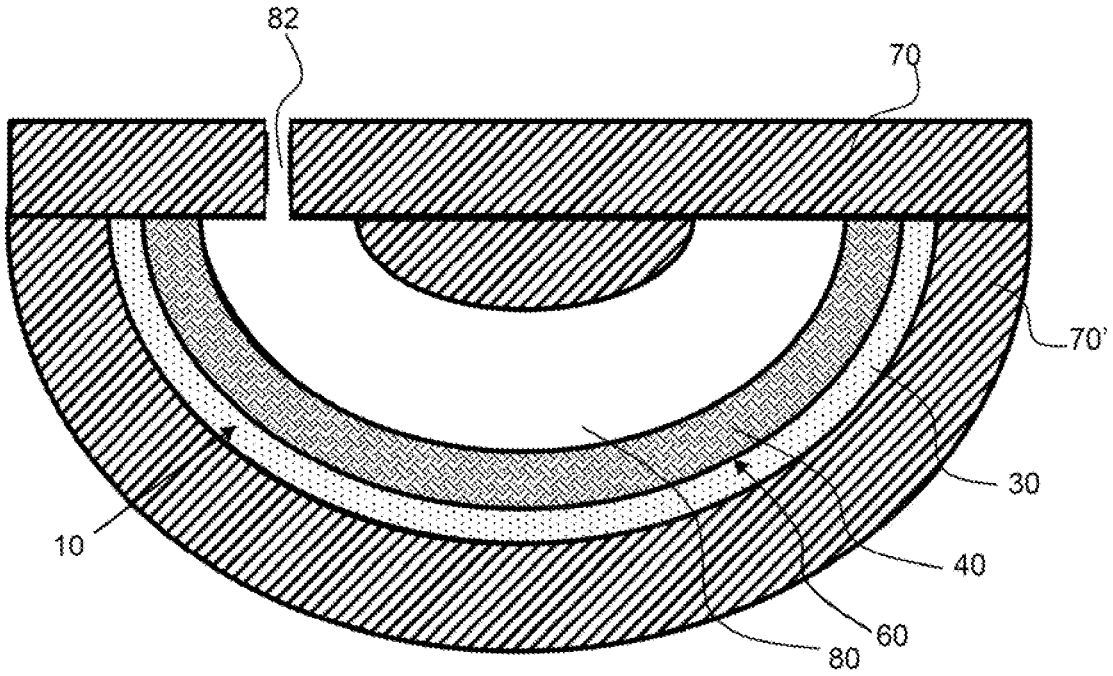
FIG. 9 is a cross sectional diagram of an exemplary tri-band radome cover being formed in a form with the strike plate and the capture layer adhered together within the form and a fill port for forming the tuning layer in the gap in situ.
Figure 10:
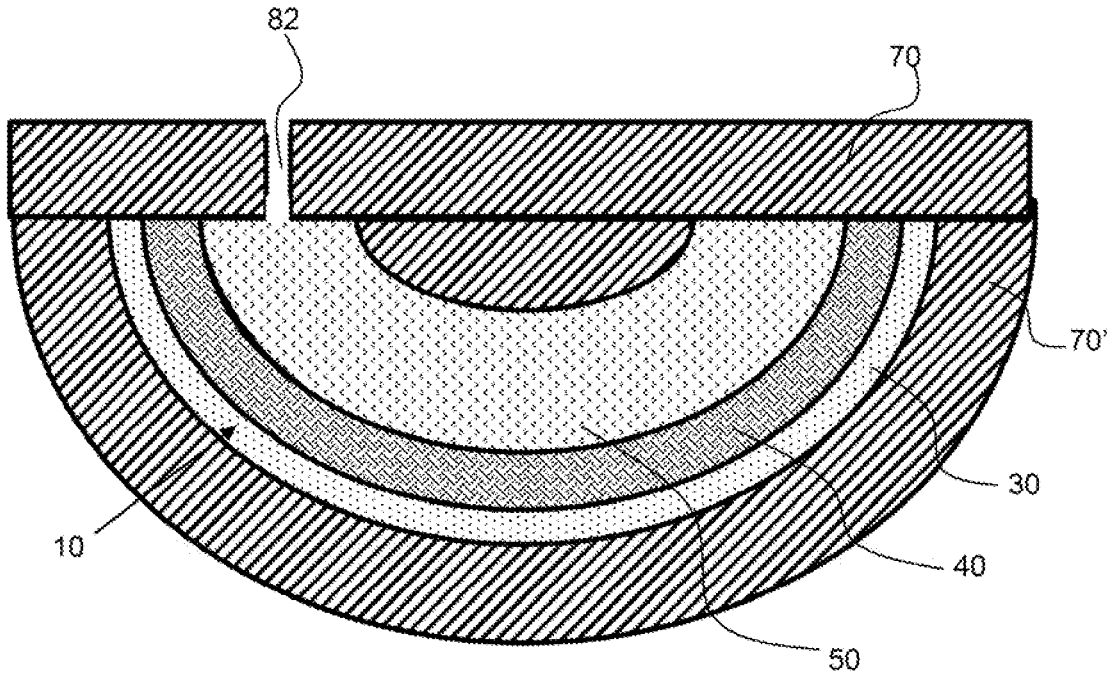
FIG. 10 shows the exemplary tri-ban radome cover of FIG. 9 with the tuning layer formed in the gap.

Referring now to FIGS. 9 and 10, a strike plate 30 is vacuum formed in a vacuum form 72. A capture layer and adhesive are configured and attached to the strike plate. A gap 80 is formed in the form 70 between the capture layer and the form. As shown in FIG. 10, a tuning layer 50 is formed in situ, such as by reaction injection molding. The tuning layer material, such as a foam is pumped into the gap 80 through fill port 82 and formed in situ.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A tri-band radome cover comprising:

a) a ballistic protective composite comprising:

i) an outside surface;

ii) an inside surface;

iii) a strike plate configured on the outside surface and consisting essentially of a thermoplastic polymer sheet and having a strike plate dielectric constant of between 2 and 4;

iv) a capture layer;

v) a tuning layer configured on the inside surface and comprising a low density material having a density of no more than 0.64 g/cc;

wherein the capture layer is configured between the strike plate and the tuning layer;

wherein the strike plate dielectric constant is greater than the capture layer dielectric constant and wherein the capture layer dielectric constant is greater than the tuning layer dielectric constant;

wherein the ballistic protective composite has a progressively decreasing dielectric constant from the outside surface to the inside surface.

2. The tri-band radome cover of claim 1, wherein the strike plate has a dielectric constant of greater than 3.0.

3. The tri-band radome cover of claim 2, wherein the capture layer has a dielectric constant of between 1.8 and 3.

4. The tri-band radome cover of claim 2, wherein the tuning layer has a dielectric constant of between 1.08 and 2.

5. The tri-band radome cover of claim 1, wherein the strike plate has an impact resistance of at least 2 J/cm.

6. The tri-band radome cover of claim 5, wherein the strike plate consists of a polycarbonate sheet.

7. The tri-band radome cover of claim 6, wherein the polycarbonate sheet has a thickness of at least 0.5 mm and no more than 3 mm.

8. The tri-band radome cover of claim 1, wherein the strike plate thermoplastic polymer sheet is selected from the group of thermoplastic polymer sheets consisting of: polycarbonate, polyetherimide, polystyrenes and polysulfones.

9. The tri-band radome cover of claim 1, wherein the capture layer is configured to stop ballistic material and comprises a fibrous composite.

10. The tri-band radome cover of claim 9, wherein capture layer comprises a plurality of fibrous sheets, each of said fibrous sheets comprising highly oriented polyethylene fibers having a fiber orientation direction.

11. The tri-band radome cover of claim 10, wherein the fibrous composite of the capture layer comprises a binder that adheres the plurality of fibrous sheets together.

12. The tri-band radome cover of claim 11, wherein the binder is present in the capture layer at a concentration of no more than 20% by weight.

13. The tri-band radome cover of claim 10, wherein the sheets are configured at offset angles, wherein a first sheet has a first fiber orientation direction and a second sheet has a second fiber orientation direction that is offset by said offset angle to the first fiber orientation direction by at least 30 degrees.

14. The tri-band radome cover of claim 1, wherein the tuning layer comprises a foam.

15. The tri-band radome cover of claim 14, wherein the foam is an open cell foam.

16. The tri-band radome cover of claim 14, wherein the tuning layer comprises a polyurethane foam.

17. The tri-band radome cover of claim 1, wherein the tuning layer is attached to the capture layer and has a thickness between 0.2 mm and 10 mm.

18. The tri-band radome cover of claim 1, wherein the strike plate dielectric constant is between 2.6 and 3.4, wherein capture layer dielectric constant is between 1.8 and 2.4 and the tuning layer dielectric constant is between 1.08 and 1.5.

19. The tri-band radome cover of claim 1, having a dB loss over a wavelength of 8 to 40 GHz of no more than 1 dB.

20. The tri-band radome cover of claim 1, having an X band dB loss over a wavelength of 8 to 12-GHz of no more than 1 dB, having a Ku band dB loss over a wavelength of 12 to 18 of no more than 1 dB, and having a Ka band dB loss over a wavelength of 26 to 30 GHz of no more than 1 dB.

* * * * *